US005259586A

United States Patent [19]

Miller, Sr.

[11] Patent Number: 5,259,586

[45] Date of Patent: Nov. 9, 1993

[54] MOLD INSERT FOR FORMING PRECAST CONCRETE MODULES

[76] Inventor: Arthur C. Miller, Sr., Main & Bridge St., Spring City, Pa. 19475

[21] Appl. No.: 883,982

[22] Filed: May 18, 1992

[51] Int. Cl.[5] ..... B28B 7/00

[52] U.S. Cl. ..... 249/99; 249/101; 249/155; 249/156

[58] Field of Search ..... 249/34, 98–101, 249/144, 155, 156, 189, 192, 196; 52/541

[56] References Cited

U.S. PATENT DOCUMENTS

| | | | |
|---|---|---|---|
| 939,059 | 11/1909 | Mofris | 249/149 |
| 1,219,131 | 3/1917 | Moore | 249/99 |
| 1,543,635 | 1/1923 | Wickson | 52/603 |
| 2,386,582 | 6/1944 | Woodward | 249/177 |
| 2,486,038 | 10/1949 | Landon | 249/177 |
| 2,559,296 | 7/1951 | Hansen | 249/153 |
| 2,730,785 | 1/1956 | Williams et al. | 249/98 |
| 2,823,439 | 2/1958 | Schmidgall | 249/100 |
| 2,966,713 | 1/1961 | Billner | 249/100 |
| 3,047,929 | 8/1962 | Steiro | 264/23 |
| 3,539,146 | 11/1970 | Smith | 249/144 |
| 3,567,171 | 3/1971 | Slominski | 249/9 |
| 3,835,586 | 9/1974 | Gates et al. | 49/463 |
| 3,922,135 | 11/1975 | Haller et al. | 425/432 |
| 3,941,347 | 3/1976 | Robertson et al. | 249/100 |
| 4,047,693 | 9/1977 | Holme | 425/470 |
| 4,123,033 | 10/1978 | Joelson | 249/65 |
| 4,123,034 | 10/1978 | Crunk et al. | 249/100 |
| 4,251,196 | 2/1981 | Toffolon et al. | 249/155 |
| 4,358,264 | 11/1982 | Yamamoto et al. | 425/436 R |
| 4,659,057 | 4/1987 | Felter | 249/97 |
| 5,081,805 | 1/1992 | Jazzar | 52/251 |

FOREIGN PATENT DOCUMENTS

| | | | |
|---|---|---|---|
| 3203968 | 9/1983 | Fed. Rep. of Germany | 249/100 |
| 708515 | 6/1966 | Italy | 249/100 |

*Primary Examiner*—Jay H. Woo
*Assistant Examiner*—James P. Mackey
*Attorney, Agent, or Firm*—Seidel, Gonda, Lavorgna & Monaco

[57] ABSTRACT

A mold insert adapted to be inserted as a base plate in a forming apparatus for molding precast concrete modules, for the purpose of forming a sloped rabbet in the wall sills of the concrete module. The insert is shaped such that when inserted in one orientation it produces an outside edge rabbet, and when inserted in an inverted orientation produces an inside edge rabbet. It comprises an extruded-aluminum hollow main beam having a top flange, a bottom flange, side walls, and one or more supporting webs, and has a section profile which is substantially in the shape of a flattened Z-section. The beam's width dimension is chosen for close conforming fit between the inner and outer form sections. Each side wall has two C-channels having a circular curvature and adapted to receive and support resilient tubing sealing members. The width of the insert can be expanded by expansion beams having circular boss rails adapted to slide into the C-channels of the main beam. Mold inserts can be elongated by welding main beam sections together, and the ends of the beams can be mitered and welded together as necessary to produce rabbets with inside or outside corners.

5 Claims, 3 Drawing Sheets

MOLD INSERT FOR FORMING PRECAST CONCRETE MODULES

TECHNICAL FIELD

This invention is related to the general field of precast concrete modules which are later assembled and interlocked to produce concrete structures, such as culverts, tunnels and vaults. It is related to the specific field of molds and mold inserts used to form such precast modules.

BACKGROUND ART

It is a common practice to use precast concrete modules to build concrete structures rather than erect a form on the site to pour the entire structure in position. The modules can be precast in standard shapes and sizes, with reinforcing rods and various inserts, and delivered to the site to be assembled into the structure. For example, rectangular concrete culverts are easy constructed by precasting concrete C-channels in standard modular lengths, joining module pairs, one on top of the other, at their respective wall sills to produce a rectangular culvert section, and joining such sections end-to-end to the desired overall length.

In addition to channel modules, other modular shapes such as rectangular boxes, squares, and pentagons are use to form more complex structures such as sub-terrain tanks, vaults and habitable enclosures.

The modules are cast in reusable forms. A representative form of this type is described in U.S. Pat. No. 3,539,146. For brevity, the disclosure of that patent is incorporated herein by reference so that details concerning operation of the form need not be repeated here in great detail.

In simplest terms, such forms can be described as comprising a base with inner and outer form sections attached thereto, with a base plate located between the inner and outer form sections. As shown in the referenced disclosure of U.S. Pat. No. 3,539,146, the base plate may be configured to mold a mating keyway into the wall sills, such as the tongue and groove keyway disclosed in its drawings. This requires using different base plates for the opposing concrete sections, such as the tongue producing plate 34 shown in FIG. 3 of U.S. Pat. No. 3,539,146 and the groove producing plate 34 shown in its FIG. 5.

It is also known to use inside and outside rabbets (also called "rebates" or "ship laps") as keying structure to join concrete sections. This inventor believes the mating rabbets to be a superior keying structure for joinder of massive concrete structures, such as the culvert section (10) depicted in FIG. 1 herein. A concrete module (12), formed with an inside rabbet on its wall sills, is placed in the culvert excavation as the bottom of the culvert. Then a module (14), formed with an outside rabbet on its wall sills, can be lowered onto it, letting the walls of the rabbets contact and center the upper module in place as it is lowered. The seam can be tarred or caulked if necessary for water tight integrity.

In the prior art of casting concrete, rabbets have long been made by inserting a rectilinear bar or an L-angle bar into the form at the wall sill, such as disclosed in U.S. Pat. No. 939,059 (see inserts 17 and rabbet 151 therein). However, for joinder of massive concrete structures, such as the culvert section (10) depicted in FIG. 1 herein, this inventor believes that the mating rabbets should have sloped upright walls with rounded shoulders, rather than sharp vertical walls that would be formed by right angle inserts. This shape allows the top module to be lowered onto the bottom module and be centered by the rabbets more easily.

An objective of this invention is to provide a mold insert that can be inserted in a concrete form apparatus to produce such sloped rabbets, and in particular to be capable of producing both inside and outside rabbets. This objective would be achieved by a mold insert which in one orientation produces an outside edge rabbet in the concrete, and when inserted in an inverted orientation produces an inside edge rabbet in the concrete.

A further objective is to provide a mold insert with improved sealing and close conform fit between the inner and outer form sections to seal against seepage of liquid concrete mix past the insert.

A further objective is to provide a mold insert which can be expanded in width, elongated, and/or end-mitered as necessary to accommodate forms which produce a variety of module shapes.

A further objective is to produce a mold insert that can bear the weight of a large column of liquid concrete, yet be sufficiently light-weight that it can be easily removed from the forming apparatus.

The manner in which such objects are achieved by the present invention will be apparent upon reading the detailed description which follows, with reference to the drawings for illustration of a particular embodiment. By way of overview, and to assist cursory searchers who do not wish to read the entire disclosure, the following section is provided as a brief summary disclosure of the invention in perfunctory and informal terms. However, persons seeking to understand the full scope of the invention should be aware that such understanding can only come from careful reading of the claims found at the end of this document.

SUMMARY DISCLOSURE OF THE INVENTION

The invention is directed to an mold insert which is adapted to be inserted as a base plate in a forming apparatus for molding precast concrete modules, for the purpose of forming a sloped rabbet in the wall sills of the concrete module.

The insert comprises an elongated member being shaped such that when inserted in one orientation it produces an outside edge rabbet, and when inserted in an inverted orientation produces an inside edge rabbet. The elongated member is a hollow beam comprising a top flange, a bottom flange, side walls, and one or more supporting webs, and has a section profile which is substantially in the shape of a flattened Z-section. It is preferably an extruded aluminum beam.

The elongated hollow beam has a width dimension which is chosen for close conform fit between its side walls and the inner and outer form sections. Each side wall includes at least one channel adapted to receive and support a resilient sealing member against a form section. In a preferred embodiment, each side wall has two C-channels having a circular curvature and adapted to receive and support resilient tubing having a radius essentially equal to the radius of the curvature of the C-channel.

The mold insert can be expanded in width by expansion beams having circular boss rails adapted to slide into the C-channels of the main beam. The expansion beams have top and bottom flanges to match the top and bottom flanges of the main beam, and C-channels to accept the resilient tubing. Inserts can be elongated by joining beam sections together, and the ends of the beams can be mitered and joined as necessary to produce rabbets with inside or outside corners. Thus, the basic shape of the hollow beam will accommodate forms which produce a variety of module shapes and sizes.

BRIEF DESCRIPTION OF THE DRAWINGS

For the purpose of illustrating the invention, the drawings show a form which is presently preferred; it should be understood, however, that this invention is not limited to the precise arrangements and instrumentalities shown.

BEST MODE FOR CARRYING OUT THE INVENTION

Figure 1:
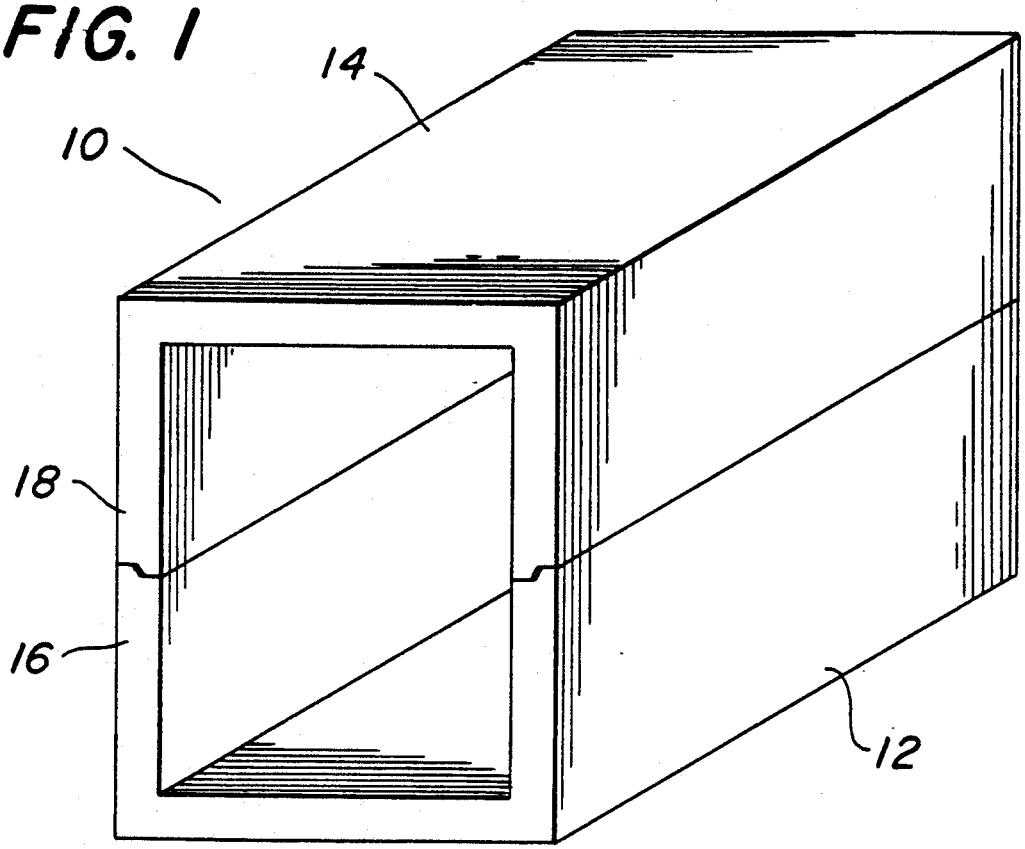
FIG. 1 depicts a perspective view of a concrete culvert structure assembled from two concrete modules cast with mating rabbets formed in their respective wall sills by a mold insert member according to the present invention.
Figure 3:
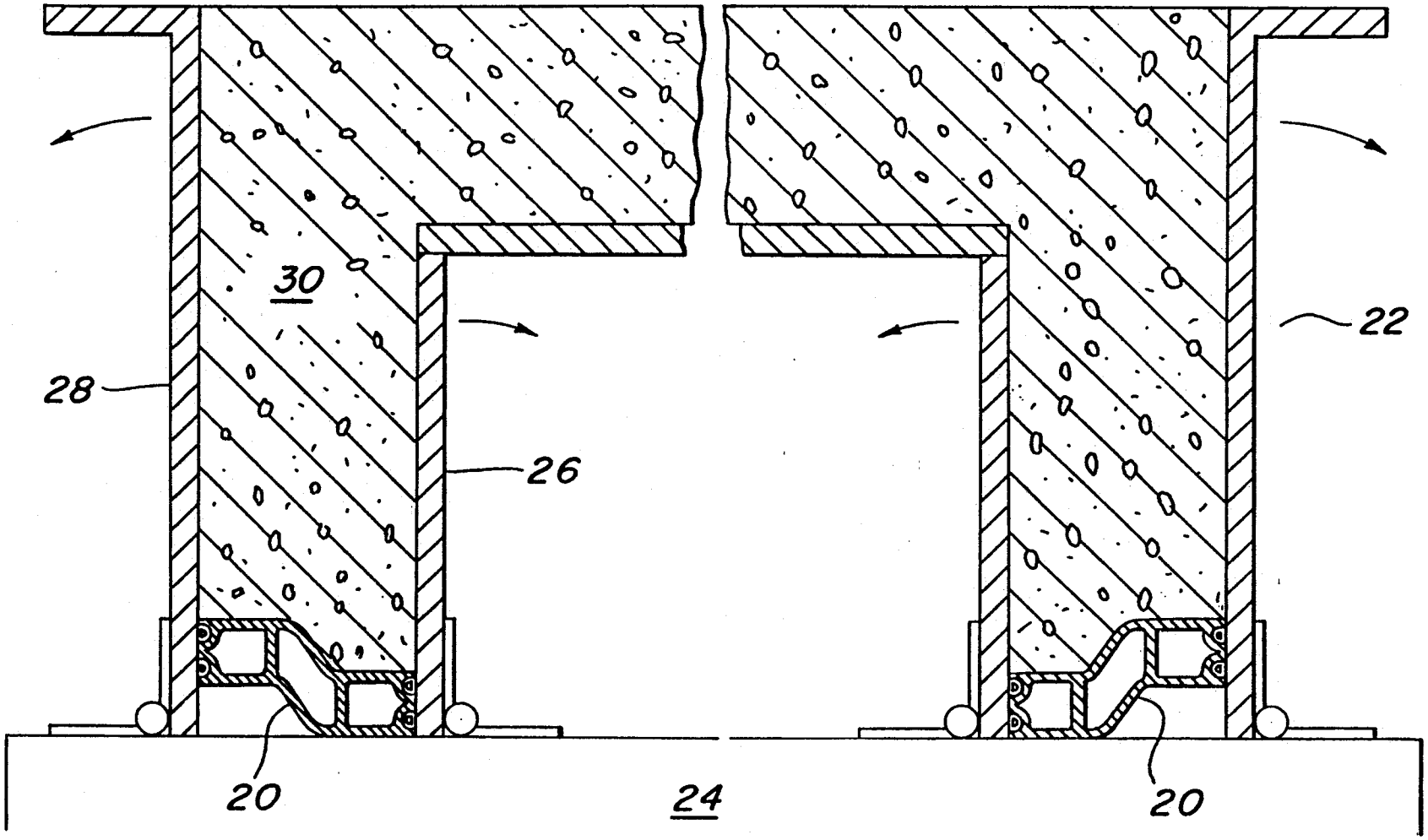
FIG. 3 depicts a front section view of a representative concrete forming apparatus having a mold insert according to the present invention installed as a base plate to form a concrete module with an outside rabbet in its wall sills.

FIG. 1 depicts a concrete culvert structure (10) assembled from two concrete modules (12, 14) cast with mating rabbets formed in their respective wall sills by a forming apparatus as depicted in FIG. 3. One concrete module (12) is formed with an inside rabbet on its wall sills (16). A second concrete module (14) is formed with an outside rabbet on its wall sills (18). The rabbets have sloped upright walls with rounded shoulders, as will be apparent from the description and drawings of the mold insert used to form the rabbets.

The rabbets with sloped walls and rounded shoulders act as keying structure which facilitates assembly of the modules into a structure. For example, the module (12) may be placed in an excavated ditch to be the bottom of a culvert. Then the opposite module (14) can be lowered onto it, letting the walls of the rabbets contact and align the upper module as it is lowered.

A module (14) with an outside rabbet of this type may be cast by placing a mold insert (20) as a base plate in a form apparatus (22) for molding precast concrete modules, in the orientation depicted in FIG. 3. Such forming apparatus (22) is disclosed in U.S. Pat. No. 3,539,146, and is representative of a type of form comprised of a base member (24) with inner form sections (26) and outer form sections (28) attached thereto. The insert (20) is inserted as a base plate between the inner (26) and outer (28) form sections for the purpose of forming a rabbet in the poured concrete (30).

Figure 2:
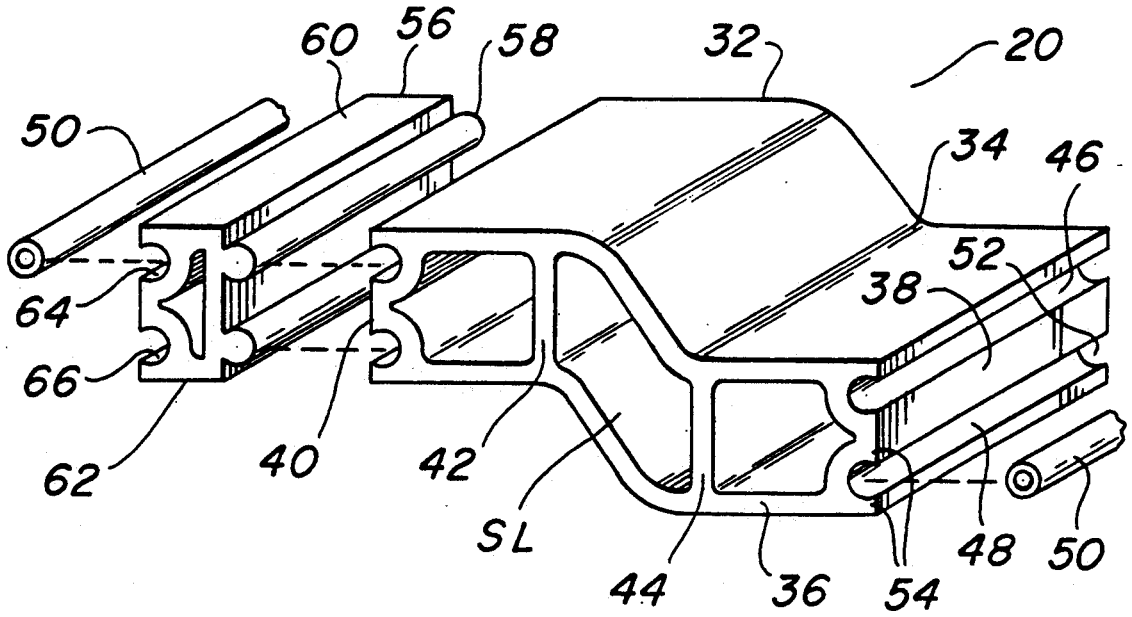
FIG. 2 depicts a perspective exploded section of a mold insert member according to a preferred embodiment of the invention.

The mold insert (20) is shown in greater detail in FIG. 2. It comprises an elongated hollow beam (32) having a top flange (34), a bottom flange (36), side walls (38, 40), and supporting webs (42, 44). The top flange (34) and bottom flange (36) are each substantially in the shape of a flattened Z-section, and are symmetrically spaced from each other by the side walls and webs, thus giving the elongated hollow beam (32) an overall section profile which is substantially in the shape of a flattened Z-section. (As used herein, "Z-section" refers to the British Standard Section for Rolled Steel Beams, not the shape of a typeface Z. The term "flattened Z-section" indicates that the upright web is sloped past the vertical. In the depicted embodiment, the equivalent slope of the sloped portion $S_L$ is approximately 135°.) By this shape, the insert (20) has the desired characteristic that when it is inserted in a form apparatus in one orientation (as shown in FIG. 3) it produces an outside edge rabbet in the concrete, and when inserted in an inverted orientation produces an inside edge rabbet. Thus, the insert (20) may be used to cast both modules (12, 14).

The mold insert (20) is further intended to provide improved sealing and close conform fit between the inner (26) and outer (28) form sections to seal against seepage of liquid concrete mix past the insert. To achieve this objective, each side wall (38, 40) has two parallel channels (46, 48) extending the length of the wall and adapted to receive and support a resilient tubing (50). Each channel is shaped as a C-channel having a circular curvature, and the tubing is preferably a hollow rubber or plastic tubing with a radius essentially equal to the radius of the curvature of the C-channel. Thus, the tubing (50) may be pressed into the open slot (52) of the C-channels and held in place by the lip overlaps (54), but protrude from the channels to contact the form sections.

The basic elongated hollow beam (32) is sized to provide a close conform fit between the inner and outer form sections when the outer form sections (28) are pivoted at their hinges into the closed position as shown in FIG. 3. This compresses the resilient tubing (50) against both inner and outer form sections to seal against seepage of liquid concrete mix past the insert.

The flattened Z-section also contributes to conform fit and sealing effect. As apparent from FIG. 3, the weight from a column of wet concrete is a compression load on the hollow beam (32), which because of the equivalent web slope $S_L$ produces an expansion force pushing the side walls of the beam into the inner and outer form sections. The supporting webs (42, 44) are therefore located at the edges of the slope to provide vertical weight bearing without inhibiting this expansion force against the form sections.

To provide a mold insert which can be expanded in width, an expansion beam (56) is provided with circular boss rails (58) adapted to slide into the C-channels (46, 48) of the main beam (32). The expansion beam has a top flange (60) and a bottom flange (62) to match the top (34) and bottom (36) flanges of the main beam, and a pair of C-channels (64, 66) identical to the channels in the main beam to accept the resilient tubing (50).

Thus, if the basic beam is made with eight-inch width for the smallest standard concrete wall, and expansion beams are made in one-inch widths, the mold insert can be symmetrically expanded in two-inch increments by adding equal numbers of expansion beams on each side. Other width configurations could be chosen for the main beam and/or the expander beams.

A longer insert may be made by joining a section of identical beam to the elongated beam (32). For example, if the beam (32) is extruded in twelve-foot standard lengths, and it is desired to have a mold insert of sixteen-foot length, a four-foot section may be cut from one standard beam and abutted to the end of another to create a sixteen-foot length. The abutment may be held in place by welds or by aluminum pegs, as described below in reference to FIG. 4.

Figure 4:
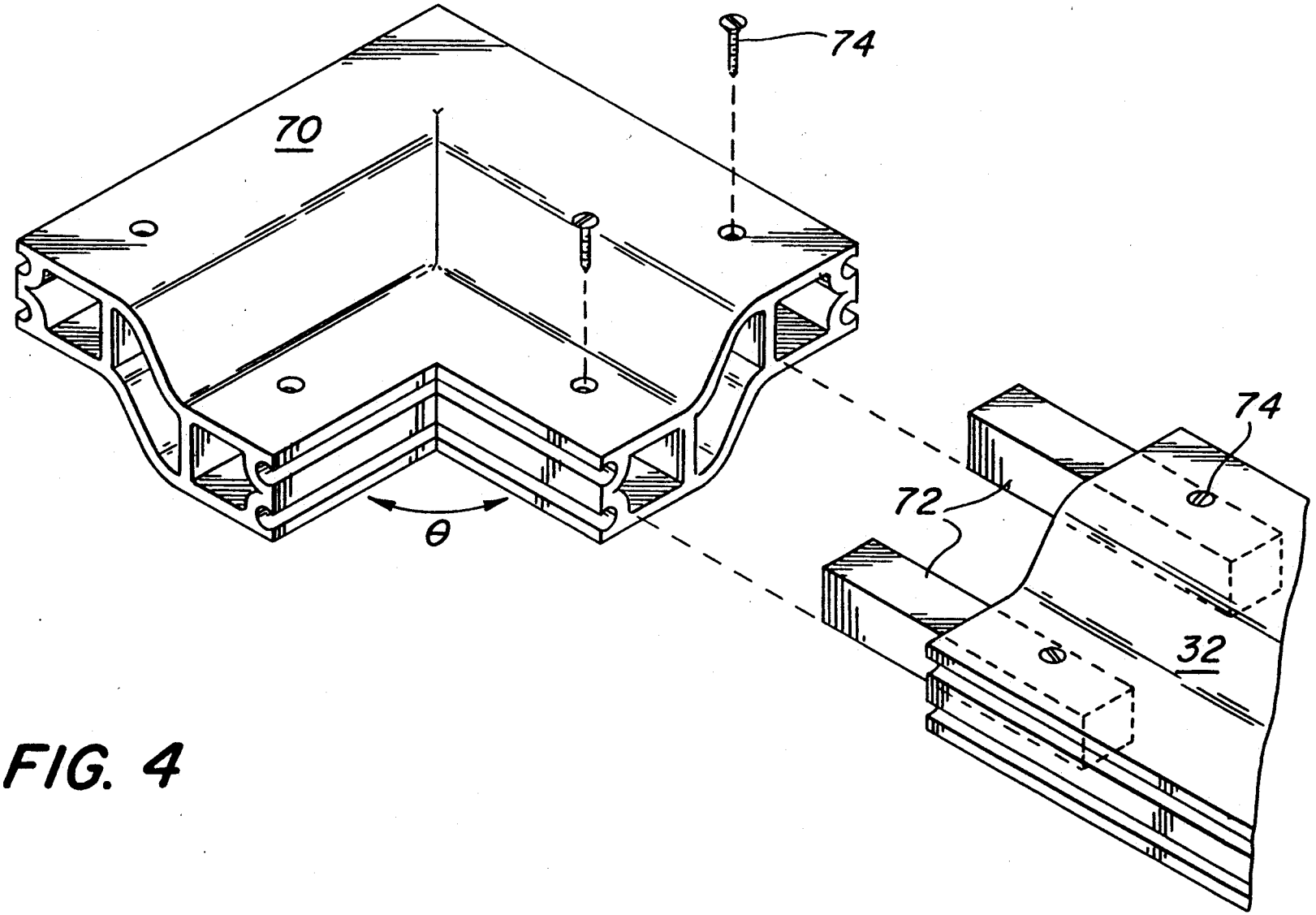
FIG. 4 depicts a perspective view of an alternative embodiment insert having a pre-formed corner piece and a straight elongated section.

The beams may also be mitered at their ends and joined together to form inside or outside corners to produce an insert with corner or complex shapes. Alternatively, as depicted in FIG. 4, standard corner sections such as corner section 70 may be pre-formed for the various angles $\theta$ which are frequently used. An elongated beam 32 may then be joined at each side of the corner section 70. Short aluminum pegs 72 may be inserted into the openings along the support webs to hold the alignment of the sections. Such pegs may be fixed to one of the sections by weld, pin or screw 74. Thus, the hollow beams can be used to form a variety of module shapes and sizes.

INDUSTRIAL APPLICABILITY

The invention is expected to be used primarily by manufactures of standard and custom precast concrete modules. The invention allows the module manufacturer to create opposing rabbets to act as an effective mating keyway in the wall sills of the modules, and is highly versatile in that the same extruded aluminum beam can be used to form inserts of a variety of shapes and sizes.

The present invention may be embodied in other specific forms without departing from the spirit or essential attributes thereof and, accordingly, reference should be made to the appended claims, rather than to the foregoing specification, as indicating the scope of the invention.

What is claimed is:

1. An insert member adapted to be inserted as a base plate in a forming apparatus for molding precast concrete modules, said forming apparatus being comprised of a base member with inner and outer form sections attached thereto, said insert member being inserted as a base plate between the inner and outer form sections for the purpose of forming a rabbet in the concrete, said insert member comprising:

(a) an elongated member shaped such that when inserted in said forming apparatus in one orientation it produces an outside edge rabbet in the concrete, and when inserted in an inverted orientation produces an inside edge rabbet in the concrete;

(b) means for expanding the width of said elongated member such that its width may be chosen for close conforming fit between the inner and outer form sections; and (c) said elongated member having side walls for contact against said form sections, each side wall including at least one channel therein adapted to receive and support a resilient sealing member against one of said form sections.

2. An insert member as in claim 1, wherein said elongated member includes a hollow main beam comprising a top flange, a bottom flange, said side walls, and one or more supporting webs, and wherein said top flange and said bottom flange are each substantially in the shape of a flattened Z-section, and are symmetrically spaced from each other by said side walls and webs.

3. An insert member as in claim 2, wherein each side wall includes two parallel channels extending along the wall, each channel adapted to receive and support a resilient sealing member against a form section.

4. An insert member as in claim 3, wherein each side wall channel is a C-channel having a circular curvature and adapted to receive and support said resilient sealing member, which member comprises a resilient tubing having a radius essentially equal to the radius of the curvature of the C-channel.

5. An insert member as in claim 4, wherein said means for expanding the width of said elongated member comprises an expansion beam provided with circular boss rails adapted to slide into the C-channels of the main beam to connect said expansion beam to the main beam, said expansion beam having a top flange and a bottom flange coplaner with the top flange and bottom flange of the main beam when so connected, and said expansion beam having a pair of C-channels identical to the channels in the main beam to accept the resilient tubing.

* * * * *